US009035165B2

(12) United States Patent
Cho

(10) Patent No.: US 9,035,165 B2
(45) Date of Patent: May 19, 2015

(54) CONTROL PEDAL AND METHOD OF CONTROLLING AN ELECTRONIC DEVICE WITH THE CONTROL PEDAL

(71) Applicant: Chiou-Ji Cho, Taichung (TW)

(72) Inventor: Chiou-Ji Cho, Taichung (TW)

( * ) Notice: Subject to any disclaimer, the term of this patent is extended or adjusted under 35 U.S.C. 154(b) by 0 days.

(21) Appl. No.: 14/261,571

(22) Filed: Apr. 25, 2014

(65) Prior Publication Data

US 2014/0331850 A1 Nov. 13, 2014

(30) Foreign Application Priority Data

May 9, 2013 (TW) ..... 102116543 A

(51) Int. Cl.

| | |
|---|---|
| ***G10H 1/32*** | (2006.01) |
| ***G10H 3/00*** | (2006.01) |
| ***G10H 1/46*** | (2006.01) |
| ***G10H 1/00*** | (2006.01) |
| ***B42D 9/04*** | (2006.01) |
| ***G10G 7/00*** | (2006.01) |

(52) U.S. Cl.

CPC ..... *G10H 1/46* (2013.01); *G10H 1/0008* (2013.01); *B42D 9/04* (2013.01); *G10G 7/00* (2013.01)

(58) Field of Classification Search

USPC ..... 84/721, 744, 225, 426

See application file for complete search history.

(56) References Cited

U.S. PATENT DOCUMENTS

| | | | | |
|---|---|---|---|---|
| 3,045,522 | A * | 7/1962 | Markowitz et al. | 84/711 |
| 3,558,793 | A * | 1/1971 | Nakada et al. | 84/600 |
| 5,866,829 | A * | 2/1999 | Pecoraro | 84/177 |
| 6,215,055 | B1 * | 4/2001 | Saravis | 84/422.1 |
| 7,375,273 | B2 * | 5/2008 | Sawyer-Kovelman et al. | 84/609 |
| 7,608,776 | B2 * | 10/2009 | Ludwig | 84/721 |
| 7,678,985 | B2 * | 3/2010 | Adams et al. | 84/645 |
| 8,338,689 | B1 * | 12/2012 | Beaty | 84/746 |
| 8,445,766 | B2 * | 5/2013 | Raveendran | 84/477 R |
| 8,609,973 | B2 * | 12/2013 | D'Amours | 84/746 |
| 8,680,390 | B2 * | 3/2014 | McMillen et al. | 84/746 |
| 8,802,961 | B2 * | 8/2014 | Juszkiewicz | 84/746 |
| 2003/0196542 | A1 * | 10/2003 | Harrison, Jr. | 84/737 |
| 2011/0271820 | A1 * | 11/2011 | Cockerell et al. | 84/746 |
| 2012/0144981 | A1 * | 6/2012 | Ciccone | 84/746 |
| 2013/0125736 | A1 * | 5/2013 | Osborne | 84/746 |
| 2013/0154920 | A1 * | 6/2013 | Radin et al. | 345/156 |
| 2014/0000445 | A1 * | 1/2014 | Gulak, Loren R. | 84/730 |
| 2014/0216233 | A1 * | 8/2014 | Zhonggang | 84/486 |

* cited by examiner

*Primary Examiner* — Jeffrey Donels

(74) *Attorney, Agent, or Firm* — Lin & Associates IP, Inc.

(57) ABSTRACT

A control pedal includes a pedal body having a foot contact surface at an upper side; at least a sensing unit arranged on the foot contact surface for detecting a touch action and generating a sensor signal according to the detected touch action; a microprocessor arranged in an interior of the pedal body for generating an operation instruction according to the sensor signal; and a transmission unit for transmitting the operation instruction to an electronic device to control a page turning action, sound volume adjustment, or audio mode switch.

11 Claims, 6 Drawing Sheets

CONTROL PEDAL AND METHOD OF CONTROLLING AN ELECTRONIC DEVICE WITH THE CONTROL PEDAL

CROSS-REFERENCES TO RELATED APPLICATIONS

This application claims the priority of Taiwanese patent application No. 102116543, filed on May 9, 2013, which is incorporated herewith by reference.

BACKGROUND OF THE INVENTION

1. Field of the Invention

The present invention relates to a control pedal for controlling the execution of a transmission signal so as to perform a corresponding task in an electronic device.

2. The Prior Arts

A musician generally uses sheet music during a performance. However, it may be inconvenient for the musician to manually turn the pages of the sheet music and play an instrument at the same time: for example, the sheet music may be turned to a wrong page, which may affect the performance. Moreover, the sheet music is usually in paper form, which is inconvenient to carry along with the musician.

One approach to solving the aforementioned issue is to input the sheet music and notation in an electronic device, and a press button may be used to turn the pages of the sheet music on the electronic device. Unfortunately, the use of the electronic device still requires manual operation to turn the pages of the sheet music displayed on the electronic device.

To remedy the aforementioned problem of manually turning the pages of the sheet music, a device has been developed which is operated using a foot pressure to turn the pages of the sheet music. FIG. 1 is a schematic view illustrating a conventional mechanical pedal for turning pages of sheet music. The conventional mechanical pedal 30 includes a left pedal 31 and a right pedal 32. The pedals 31 and 32 are respectively provided with sensors 311 and 321 that are adapted to generate sensing signals upon the application of a foot pressure. Page turning instructions associated with the sensing signals then are transmitted through a wireless transmitter 33 to the electronic device for executing a page turning action.

However, the above page turning control requires the assembly of the left and right pedals 31 and 32 and the wireless transmitter 33, which increase the overall volume and total weight and inconvenient to carry. Because the operator needs to use one or two feet to press on one or two of the pedals 31 and 32, the actuation may also be cumbersome. More importantly, pressing on the pedal may result in undesirable noises, and a prolonged use of the pedal may also generate parasitic noise induced by mechanical friction, which may adversely affect the quality of the performance.

When the musician is playing an electronic music instrument, the sound volume, audio mode, or chord setting is required to be manually adjusted. Playing the instrument and performing manual adjustment at the same time is not an easy task and may lead to confusion, which finally may affect the performance. Therefore, it is highly required to develop and design a pedal that can be operated by controlled with ease via the musician feet.

SUMMARY OF THE INVENTION

To address the foregoing issues, it is an object of the present invention to provide a control pedal that is simple in structure, lightweight, and can be easily portable.

It is another object of the present invention to provide a control pedal that is convenient to operate, and can detect the application of different touch actions by a foot to output proper operation instructions to control an electronic device.

It is further another object of the present invention to provide a control pedal that can sense touch actions through non-mechanical means, which eliminates the conventional problem of parasitic noise produced by a mechanical pedal.

In order to achieve the foregoing objectives, the control pedal according to one embodiment includes a pedal body having a foot contact surface at an upper side; at least a sensing unit arranged on the foot contact surface, the sensing unit detecting a touch action and generating a sensor signal according to the detected touch action; a microprocessor arranged in an interior of the pedal body, the microprocessor generating an operation instruction according to the sensor signal; and a transmission unit for transmitting the operation instruction to an electronic device.

According to one embodiment of the present invention, the sensing unit includes an infrared sensor, a light sensor, or an ultrasonic sensor.

According to one embodiment of the present invention, the transmission unit is connected with the electronic device through a wire connection.

In order to improve portability, the transmission unit is a wireless transmission unit, which may be a Bluetooth transmission unit or an infrared transmission unit.

According to some embodiments of the present invention, the operation instruction is a page turning instruction, a volume control instruction for sound, or an audio mode switch instruction. Through a setting unit, the type of the operation instruction can also be selectively switched between the page turning instruction, the volume control instruction, and the audio mode switch instruction. The page turning instruction may be executed on a display of an electronic device. The sound volume control instruction or audio mode switch instruction may be executed on an electric musical instrument or other electronic devices.

Moreover, the present invention also provides a method of controlling an electronic device with the control pedal. The method includes providing a control pedal having a foot contact surface at an upper side; through a sensing unit arranged on the foot contact surface, generating a sensor signal by applying a touch action on the control pedal; through a microprocessor, generating an operation instruction according to the sensor signal; and through a transmission unit, transmitting the operation instruction to an electronic device so as to cause the electronic device to execute a desired action.

According to some embodiments of the present invention, the touch action is a single touch followed by a lift action, a prolonged touch followed by a lift action, a sequence of two successive touches followed by a lift action, or a sequence of successive touches without lift action.

In some embodiments of the present invention, the operation instruction is a page turning instruction, which is a next page turning instruction, a previous page turning instruction, a one-page skipping instruction, or a successive page turning instruction.

According to some embodiments of the present invention, when the touch action is a single touch followed by a lift action, the associated page turning instruction is a next page turning instruction; when the touch action is a prolonged touch followed by a lift action, the associated page turning instruction is a previous page turning instruction; when the touch action is a sequence of two successive touches followed by a lift action, the associated page turning instruction is a one-page skipping instruction turning to a page immediately following the next page; and when the touch action is a sequence of successive touches without lift action, the associated page turning instruction is a successive page turning instruction. The association of each touch action with the corresponding page turning instruction may be preset by default, or may be programmed as desired through the setting unit.

The control pedal as described herein is convenient to carry along with a user. Moreover, the user can use a foot to apply different touch actions (by varying the time duration of each touch and time interval between successive touches) on the control pedal for executing page turning instructions on a display device, for example, turning electronic sheet music, electronic books, food recipes, presentation slides, and web page browsing.

According to another embodiment of the present invention, the operation instruction is a sound volume control instruction, which may be a volume increase instruction, a volume decrease instruction, or a silent mode instruction.

According to one embodiment of the present invention, when the touch action is a single touch followed by a lift action, the associated sound volume control instruction is a volume decrease instruction; when the touch action is a sequence of successive touches without lift action, the associated sound volume control instruction is a volume increase instruction; and when the touch action is a sequence of two successive touches followed by a lift action, the associated sound volume control instruction is a silent mode.

According to another embodiment of the present invention, the operation instruction is an audio mode switch instruction, which may be an instruction to switch to a previous audio mode, or an instruction to switch to a next audio mode.

According to one embodiment of the present invention, when the touch action is a single touch followed by a lift action, the associated audio mode switch instruction is an instruction to switch to the next audio mode; when the touch action is a prolonged touch followed by a lift action, the associated audio mode switch instruction is an instruction to switch to a previous audio mode.

A user can use a foot to vary the time duration of each touch and time interval between successive touches on the control pedal for controlling an electronic music instrument (for example, an electronic guitar, electronic bass, a keyboard, MIDI, DJ amplifier), or any electronic device (for example, a tablet computer, a mobile phone, etc.). Such control may include a sound volume control, or an audio mode switch control.

According to other embodiments of the present invention, in order, an anti-slip pad may also be arranged at a bottom of the control pedal to prevent its displacement when a touch action is applied thereon.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

Figure 1:
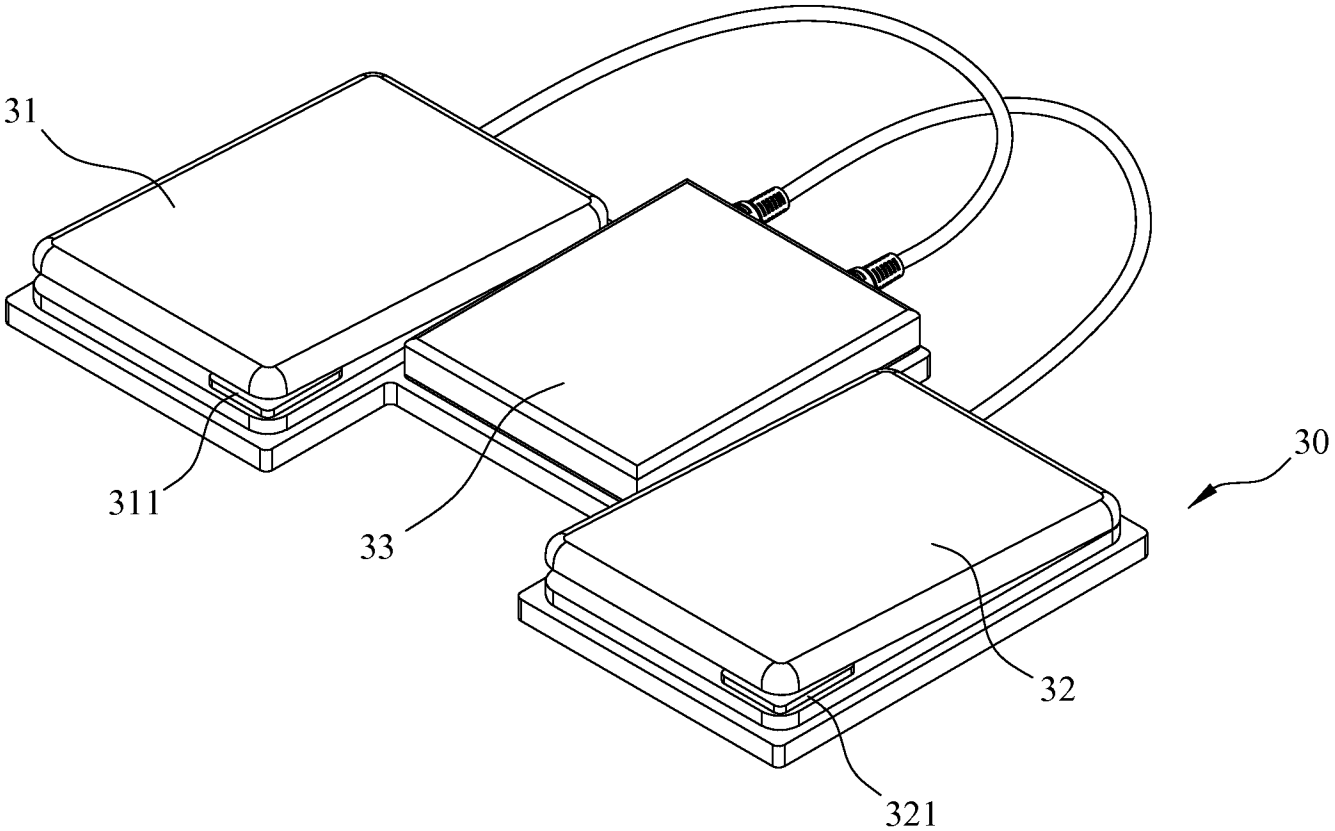
FIG. 1 (PRIOR ART)
FIG. 1 is a schematic view illustrating a conventional mechanical pedal used to control a page turning function.
Figure 2:
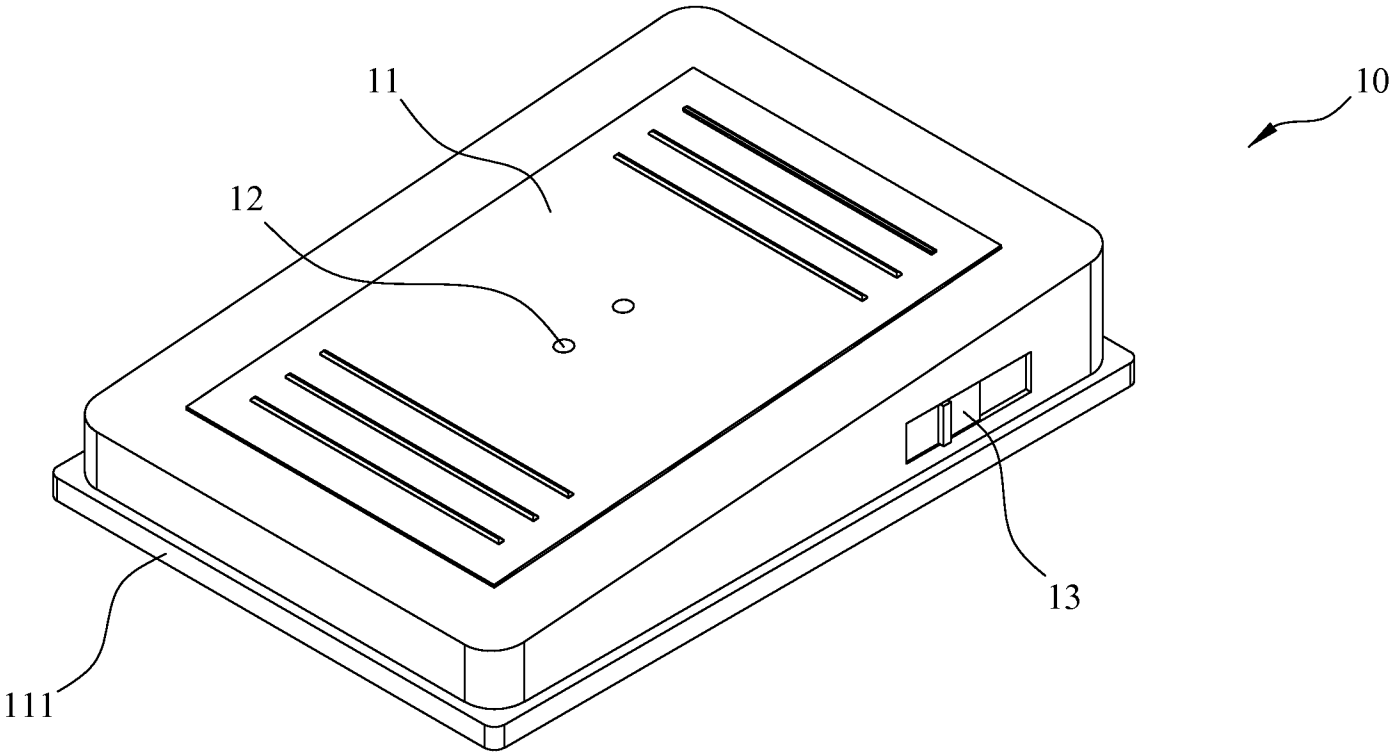
FIG. 2 is a perspective view illustrating a control pedal according to an embodiment of the present invention.
Figure 3:
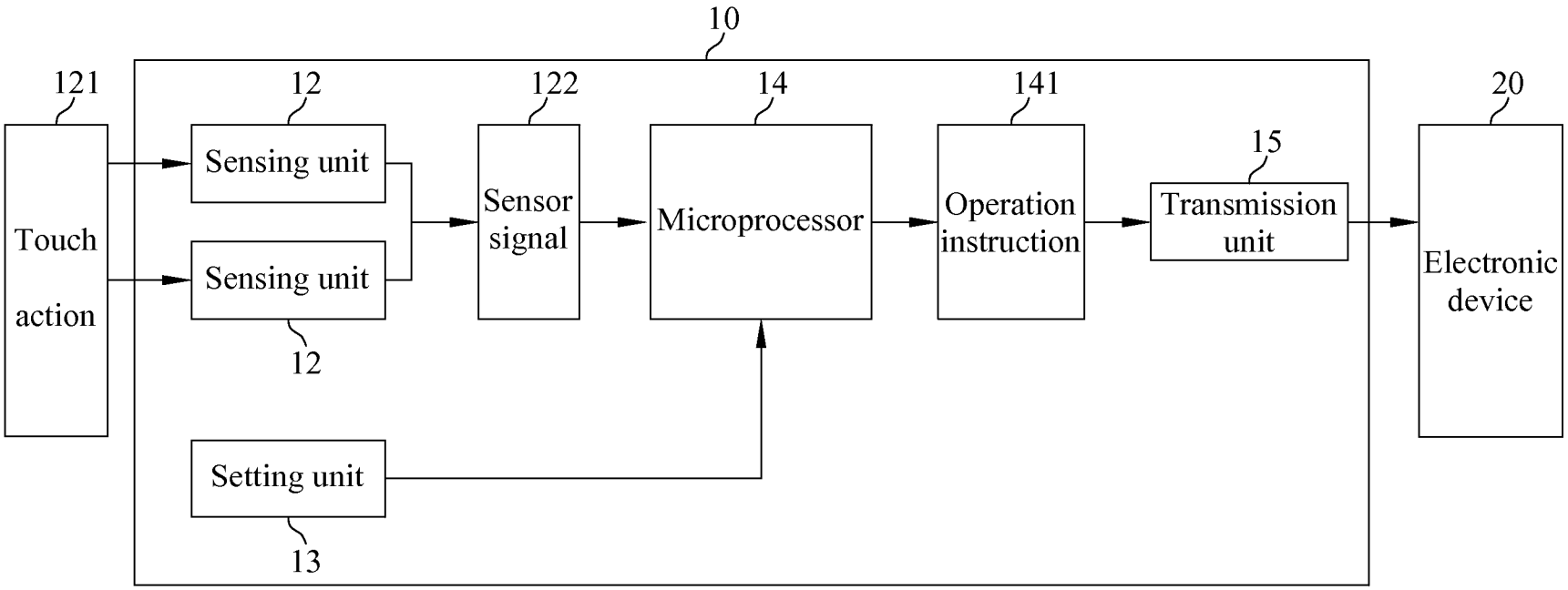
FIG. 3 is a block diagram illustrating a control pedal according to a first embodiment of the present invention.

FIGS. 2 and 3 are respectively a perspective view and a block diagram of a control pedal 10 according to an embodiment of the present invention. The control pedal 10 has a structure similar to a casing. The control pedal 10 has no shape limitation, and can have a larger or smaller surface area depending on the desired application. However, the control pedal 10 preferably has an inclined structure to facilitate foot actuation.

The control pedal 10 includes a pedal body having a foot contact surface 11 at an upper side. At least one sensing unit 12 is arranged on the foot contact surface 11. An interior of the pedal body is assembled with a microprocessor 14 and a transmission unit 15 that are electrically connected with the sensing unit 12.

The sensing unit 12 is adapted to detect the application of a touch action 121 on the control pedal 10, and generate a sensor signal 122 according to the touch action 121. The sensing unit 12 is an infrared sensor, a light sensor, an ultrasonic sensor, or any types of sensors capable of detecting a displacement and touch duration of a foot on the control pedal 10. The touch action 121 is a single touch and a lift action, a prolonged touch followed by a lift action, two successive touches followed by a lift action, successive touches without lift action, and the like.

The microprocessor 14 is adapted to identify and process the sensor signal 122. More specifically, the microprocessor 14 is adapted to generate an operation instruction 141 according to predetermined settings in response to the corresponding sensor signal 122. According to the user's needs, the microprocessor 14 is electrically connected with a setting unit 13. Through the setting unit 13, operation instructions are desirably programmed to correspond to the applied touch action 121.

Figure 4:
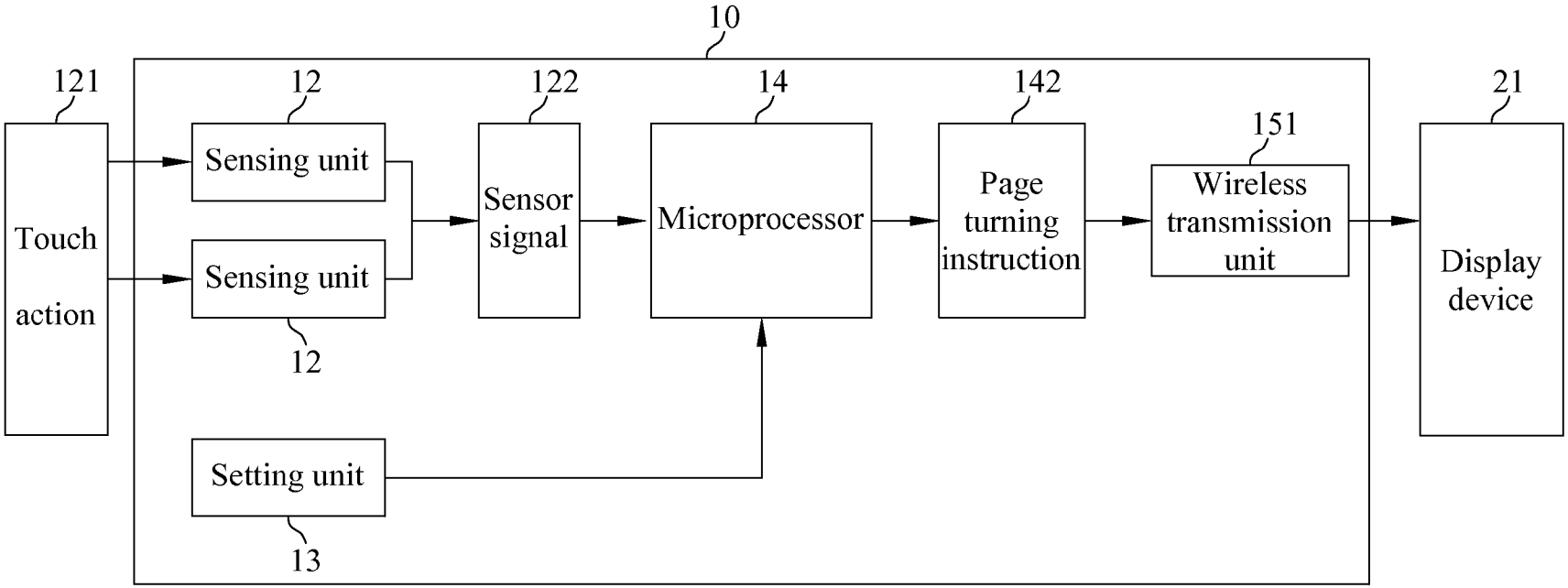
FIG. 4 is a block diagram illustrating a control pedal according to a second embodiment of the present invention.

The transmission unit 15 is adapted to transmit the operation instruction 141 to an electronic device 20, so that the electronic device 20 executes a desired action. The operation instruction 141 is transmitted out from the transmission unit 15 wirelessly or through a wire connection. If the transmission were performed through a wire connection, a connection interface is provided including a wire connection to the electronic device. If the transmission is performed wirelessly, the operation instruction 141 is transmitted from a wireless transmission unit 151 (as shown in FIG. 4) as a wireless signal to the electronic device that is capable of receiving or detecting the wireless signal. Wireless transmission facilitates portability of the control pedal 10. The wireless transmission unit 151 is a Bluetooth transmission unit or an infrared transmission unit.

The electronic device 20 includes a receiving interface, which is a wire receiving interface, or a wireless receiving interface such as Bluetooth or infrared unit.

Referring again to FIG. 3, the sensing unit 12 on the contact surface 111 of the control pedal 10 senses and detects the application of the touch action 121 by a user's foot, and then generates the sensor signal 122 in response. The sensor signal 122 is then transmitted to the microprocessor 14, which reads the sensor signal 122 and generates the operation instruction 141. The operation instruction 141 is transmitted via the transmission unit 15 to the electronic device 20 so as to cause the electronic device 20 to execute a corresponding action.

FIG. 4 is a block diagram illustrating a control pedal 10 according to a second embodiment of the present invention. The contact surface 111 of the control pedal 10 also has a sensing unit 12 that senses and detects the application of the touch action 121 by a user's foot, and then generates the sensor signal 122. The sensor signal 122 is then transmitted to the microprocessor 14, which reads the sensor signal 122 and generates a page turning instruction 142. The page turning instruction 142 is transmitted via the wireless transmission unit 151 to a display device 21 so as to execute a page turning action on the display device 21. The display device 21 preferably includes a receiving interface, which in fact is a wire receiving interface, or a wireless receiving interface such as Bluetooth or infrared unit. The display device 21 is a laptop computer, a desktop computer, a tablet computer, a projector device, and the like.

Examples of the touch action 121 include, without limitation, a single touch followed by a lift action, a prolonged touch followed by a lift action, a sequence of two successive touches followed by a lift action, a sequence of successive touches without lift action, and the like. The time duration of a touch applied on the control pedal 10 and the time interval between two successive touches are preset as desired. Moreover, examples of the page turning instruction 142 include, without limitation, a next page turning instruction, a previous page turning instruction, a one-page skipping instruction, a successive page turning instruction, or the like. According to one embodiment, when the touch action 121 is a single touch followed by a lift action, the associated page turning instruction 142 is a next page turning instruction; when the touch action 121 is a prolonged touch followed by a lift action, the associated page turning instruction 142 is a previous page turning instruction; when the touch action 121 is a sequence of two successive touches followed by a lift action, the associated page turning instruction 142 is a one-page skipping instruction turning to a page immediately following a next page; and when the touch action 121 is a sequence of successive touches without lift action, the associated page turning instruction 142 is a successive page turning instruction. The association of each touch action 121 with the corresponding page turning instruction 142 is preset by default, or is programmed as desired through the setting unit 13.

With the present invention, a user can use a foot to apply different touch actions (by varying the time duration of each touch and time interval between successive touches) on the control pedal 10 for executing different page turning instructions on a display device without the use of user's hand. The page turning instructions are applied in electronic sheet music, electronic books, food recipes, presentation slides, and web page browsing.

Figure 5:
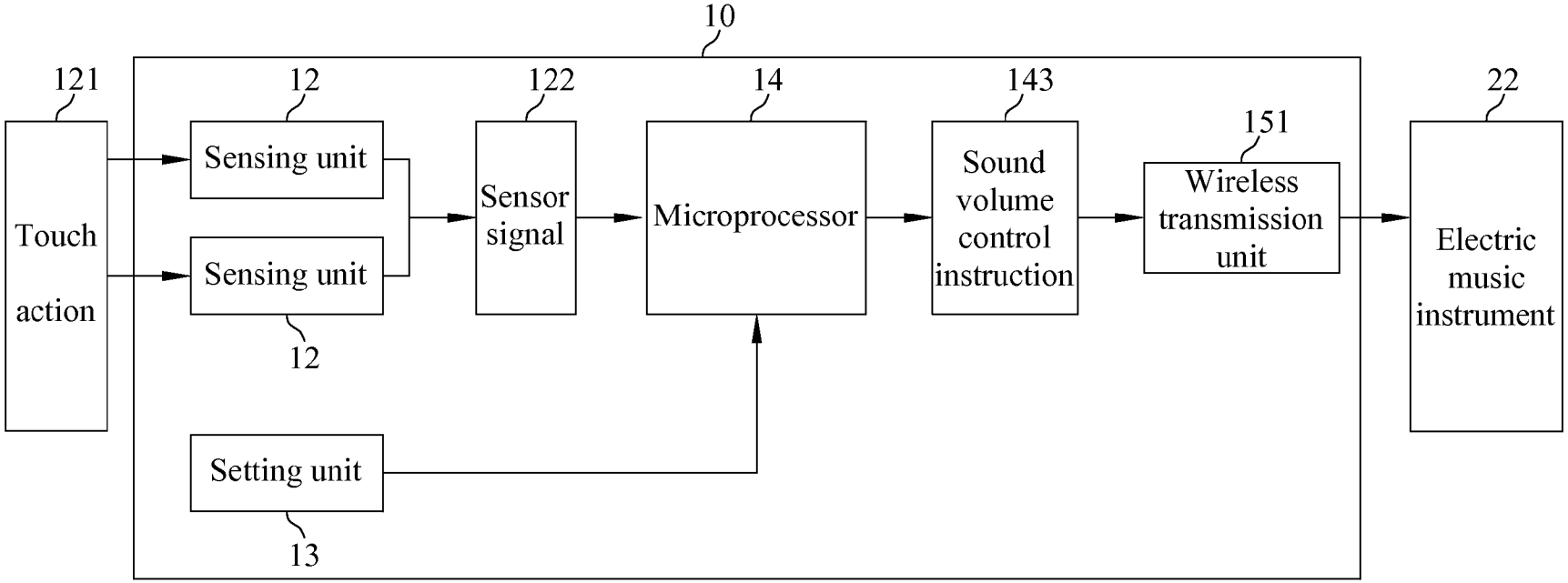
FIG. 5 is a block diagram illustrating a control pedal according to a third embodiment of the present invention.

FIG. 5 is a block diagram illustrating a control pedal 10 according to a third embodiment of the present invention. The contact surface 111 of the control pedal 10 also has a sensing unit 12 that senses and detects the application of the touch action 121 by a user's foot, and then generates the sensor signal 122. The sensor signal 122 is then transmitted to the microprocessor 14, which reads the sensor signal 122 and generates a volume control instruction 143 for sound. The volume control instruction 143 is transmitted via the wireless transmission unit 151 to an electronic music instrument 22 so as to perform sound volume control. The electronic music instrument 22 preferably includes a receiving interface, which in fact is a wire receiving interface, or a wireless receiving interface such as Bluetooth or infrared unit. Examples of the electronic music instrument 22 include, without limitation, an electronic guitar, electronic bass, a keyboard, MIDI, DJ amplifier, and the like.

Examples of the touch action 121 may include, without limitation, a single touch followed by a lift action, a timely prolonged touch followed by a lift action, a sequence of two successive touches followed by a lift action, a sequence of successive touches without lift action, and the like. The time duration of a touch applied on the control pedal 10 and the time interval between two successive touches are preset as desired. Moreover, examples of the sound volume control instruction 143 preferably include, without limitation, a volume increase, a volume decrease, or a silent mode. According to one embodiment, when the touch action 121 is a single touch followed by a lift action, the associated sound volume control instruction 143 is a volume decrease instruction; when the touch action 121 is a sequence of successive touches without lift action, the associated sound volume control instruction 143 is a volume increase instruction; and when the touch action 121 is a sequence of two successive touches followed by a lift action, the associated sound volume control instruction 143 is a silent mode. The association of each touch action 121 with a sound volume control instruction 143 is preset by default, or is programmed as desired through the setting unit 13.

Figure 6:
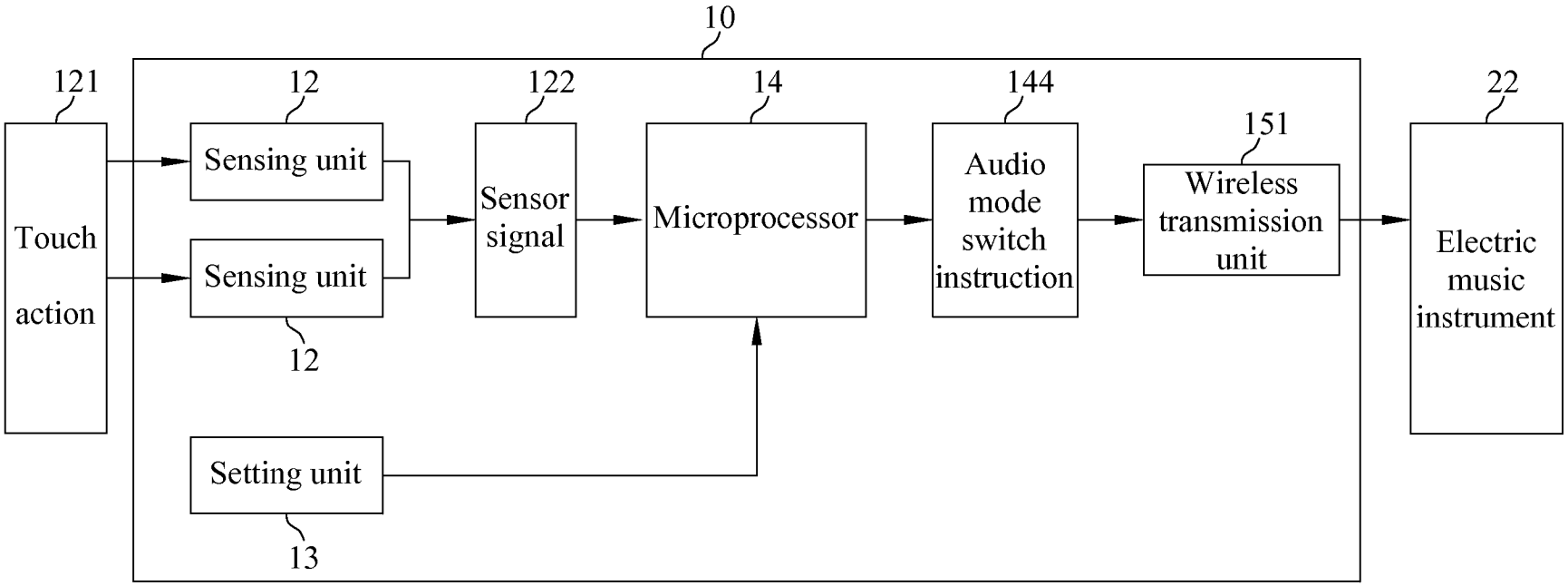
FIG. 6 is a block diagram illustrating a control pedal according to a fourth embodiment of the present invention.

FIG. 6 is a block diagram illustrating a control pedal 10 according to a fourth embodiment of the present invention. The contact surface 111 of the control pedal 10 also has a sensing unit 12 that senses and detects the application of the touch action 121 by a user's foot, and then generates the sensor signal 122. The sensor signal 122 is then transmitted to the microprocessor 14, which reads the sensor signal 122 and generates an audio mode switch instruction 144. The audio mode switch instruction 144 is transmitted via the wireless transmission unit 151 to an electronic music instrument 22 so as to switch an audio mode. The electronic music instrument 22 preferably includes a receiving interface, which in fact is a wire receiving interface, or a wireless receiving interface such as Bluetooth or infrared unit. Examples of the electronic music instrument 22 preferably includes, without limitation, an electronic guitar, an electronic bass, and the like.

Examples of the touch action 121 may include, without limitation, a single touch followed by a lift action, a timely prolonged touch followed by a lift action, a sequence of two successive touches followed by a lift action, a sequence of successive touches without lift action, and the like. The time duration of a touch applied on the control pedal 10 and the time interval between two successive touches may be preset as desired. Moreover, examples of the audio mode switch instruction 144 preferably include, without limitation, an instruction to switch to a previous audio mode, or an instruction to switch to a next audio mode. According to one embodiment, when the touch action 121 is a single touch followed by a lift action, the associated audio mode switch instruction 144 is an instruction to switch to a next audio mode; when the touch action 121 is a prolonged touch followed by a lift action, the associated audio mode switch instruction 144 is an instruction to switch to a previous audio mode. The association of each touch action 121 with the audio mode switch instruction 144 is preset by default, or is programmed as desired through the setting unit 13.

Because it is continuously pressed during operation, the control pedal is progressively displaced outward. In order to prevent this displacement, an anti-slip pad 111 (as shown in FIG. 2) may be arranged at a bottom of the control pedal 10. The anti-slip pad 111 is preferably made of rubber or any material so long as it can provide frictional contact or engagement.

The foregoing description is intended to only provide illustrative ways of implementing the present invention, and should not be construed as limitations to the scope of the present invention. While the foregoing is directed to embodiments of the present invention, other and further embodiments of the invention may thus be devised without departing from the basic scope thereof, and the scope thereof is determined by the claims that follow.

What is claimed is:

1. A method of controlling an electronic device with a control pedal, comprising:

providing a control pedal having a foot contact surface at an upper side;

through a sensing unit arranged on the foot contact surface, generating a sensor signal by applying a touch action on the control pedal;

through a microprocessor, generating an operation instruction according to the sensor signal; and through a transmission unit, transmitting the operation instruction to an electronic device so as to cause the electronic device to execute a desired action;

wherein the touch action is a single touch followed by a lift action, a prolonged touch followed by a lift action, a sequence of two successive touches followed by a lift action, or a sequence of successive touches without a lift action.

2. The method according to claim 1, wherein the operation instruction is a page turning instruction.

3. The method according to claim 2, wherein the page turning instruction is a next page turning instruction, a previous page turning instruction, a one-page skipping instruction, or a successive page turning instruction.

4. The method according to claim 1, wherein the operation instruction is a volume control instruction for sound.

5. The method according to claim 4, wherein the volume control instruction is a volume increase instruction, a volume decrease instruction, or a silent mode instruction.

6. The method according to claim 1, wherein the operation instruction is an audio mode switch instruction.

7. The method according to claim 6, wherein the audio mode switch instruction is an instruction to switch to a previous audio mode, or an instruction to switch to a next audio mode.

8. The method according to claim 1, wherein the microprocessor is connected with a setting unit operable to set different types of the operation instruction.

9. The method according to claim 8, wherein the operation instruction is a page turning instruction, a sound volume control instruction or an audio mode switch instruction.

10. The method according to claim 1, wherein the sensing unit includes an infrared sensor, a light sensor, or an ultrasonic sensor.

11. The method according to claim 1, wherein the wireless transmission unit is a Bluetooth transmission unit or an infrared transmission unit.

* * * * *